US008034237B2

(12) United States Patent
Happel et al.

(10) Patent No.: US 8,034,237 B2
(45) Date of Patent: Oct. 11, 2011

(54) BACKWASHING FILTER BASKET

(76) Inventors: Henry Happel, Rockledge, FL (US); Dolores J. Happel, legal representative, Rockledge, FL (US); Thomas H. Happel, Cocoa, FL (US)

( * ) Notice: Subject to any disclaimer, the term of this patent is extended or adjusted under 35 U.S.C. 154(b) by 494 days.

(21) Appl. No.: 12/314,711

(22) Filed: Dec. 15, 2008

(65) Prior Publication Data

US 2009/0152181 A1 Jun. 18, 2009

Related U.S. Application Data

(60) Provisional application No. 61/007,747, filed on Dec. 17, 2007.

(51) Int. Cl.
*B01D 35/22* (2006.01)
*E03F 1/00* (2006.01)

(52) U.S. Cl. ..... 210/170.03; 210/248

(58) Field of Classification Search ..... None
See application file for complete search history.

(56) References Cited

U.S. PATENT DOCUMENTS 2,852,369 A * 9/1958 Eyolfson ..... 162/251
4,658,449 A * 4/1987 Martin ..... 4/496
5,032,264 A * 7/1991 Geiger ..... 210/163
5,069,781 A * 12/1991 Wilkes ..... 210/164
5,232,587 A * 8/1993 Hegemier et al. ..... 210/162
5,284,580 A * 2/1994 Shyh ..... 210/163
5,397,464 A * 3/1995 Hannon ..... 210/163
5,403,474 A * 4/1995 Emery ..... 210/163
5,405,539 A * 4/1995 Schneider ..... 210/747.3
5,480,254 A * 1/1996 Autry et al. ..... 404/2
5,562,819 A * 10/1996 Turner et al. ..... 210/85
5,643,445 A * 7/1997 Billias et al. ..... 210/162
6,106,707 A * 8/2000 Morris et al. ..... 210/163
6,178,565 B1 * 1/2001 Franco ..... 4/291
6,270,663 B1 * 8/2001 Happel ..... 210/163
6,428,692 B2 * 8/2002 Happel ..... 210/155
6,478,954 B1 * 11/2002 Turner et al. ..... 210/162
6,537,446 B1 * 3/2003 Sanguinetti ..... 210/163
6,562,233 B1 * 5/2003 Schilling et al. ..... 210/164
6,668,390 B1 * 12/2003 Gonzalez ..... 4/291
6,793,811 B1 * 9/2004 Fleischmann ..... 210/163
6,797,161 B2 * 9/2004 Use et al. ..... 210/131
6,797,162 B2 * 9/2004 Happel ..... 210/163
6,824,677 B2 * 11/2004 Martinez ..... 210/97
6,869,525 B1 * 3/2005 Happel ..... 210/163
6,936,163 B2 * 8/2005 Use et al. ..... 210/131
6,939,461 B2 * 9/2005 Use et al. ..... 210/131
6,951,607 B2 * 10/2005 Use et al. ..... 210/122
6,979,148 B2 * 12/2005 Happel et al. ..... 405/43
6,994,783 B2 * 2/2006 Use et al. ..... 210/131
7,011,743 B2 * 3/2006 Use et al. ..... 210/131
7,033,496 B2 * 4/2006 Thacker et al. ..... 210/305
7,083,721 B2 * 8/2006 McClure et al. ..... 210/155
7,094,337 B2 * 8/2006 Williams et al. ..... 210/162
7,108,783 B2 * 9/2006 Glazik ..... 210/163

(Continued)

*Primary Examiner* — Robert James Popovics
(74) *Attorney, Agent, or Firm* — William M. Hobby, III

(57) ABSTRACT

The present invention is for a self-cleaning filter basket for an overflow structure for a retention pond or storm water system. The filter basket is attached to the overflow structure over the outlet weir so that floating debris, such as trash, leaves, glass clippings, tree stems, and the like, is captured by the filter basket while sand, gravel and non-floating materials pass through the filter screen. The self-cleaning filter basket screens are cleaned by water, such as rain water, being directed through openings in the top of the filter basket to impinge against the angled screen sides in the filter basket to flush accumulated debris therefrom.

5 Claims, 4 Drawing Sheets

U.S. PATENT DOCUMENTS 7,112,274 B1 * 9/2006 Sanguinetti ..... 210/163
7,132,045 B1 * 11/2006 Trangsrud ..... 210/163
7,153,417 B2 * 12/2006 Happel ..... 210/122
7,186,333 B2 * 3/2007 Kluge ..... 210/164
7,246,968 B1 * 7/2007 Priest ..... 404/2
7,258,785 B2 * 8/2007 Weir et al. ..... 210/163
7,270,747 B2 * 9/2007 Happel et al. ..... 210/162
7,276,156 B2 * 10/2007 Lockerman et al. ..... 210/162
7,294,256 B2 * 11/2007 Happel et al. ..... 210/155
7,300,590 B2 * 11/2007 Weir et al. ..... 210/747.3
7,309,420 B1 * 12/2007 Trangsrud ..... 210/163
7,396,471 B2 * 7/2008 Wimberger ..... 210/747.3
7,485,218 B2 * 2/2009 Dussich, I ..... 210/164
7,488,414 B2 * 2/2009 Wimberger ..... 210/163
7,494,585 B2 * 2/2009 Nino ..... 210/170.03
7,534,355 B2 * 5/2009 Lockerman et al. ..... 210/747.3
7,704,386 B2 * 4/2010 Ventura ..... 210/163
7,722,763 B2 * 5/2010 Benty et al. ..... 210/162
7,771,591 B2 * 8/2010 Lucas ..... 210/163
7,785,464 B2 * 8/2010 Happel ..... 210/164
7,799,235 B2 * 9/2010 Olson et al. ..... 210/767
7,815,800 B2 * 10/2010 Komatsu ..... 210/232
7,820,040 B2 * 10/2010 Moll et al. ..... 210/131
7,846,327 B2 * 12/2010 Happel et al. ..... 210/155
7,959,799 B2 * 6/2011 Happel et al. ..... 210/163
2001/0047954 A1 * 12/2001 Happel ..... 210/155
2002/0057944 A1 * 5/2002 Adams et al. ..... 405/39
2002/0070151 A1 * 6/2002 Houk ..... 210/163
2003/0132150 A1 * 7/2003 Happel ..... 210/163
2003/0136717 A1 * 7/2003 Tseng ..... 210/163
2003/0175079 A1 * 9/2003 Happel et al. ..... 405/46
2004/0035772 A1 * 2/2004 McGinn ..... 210/163
2004/0065601 A1 * 4/2004 Martinez ..... 210/97
2004/0226869 A1 * 11/2004 McClure et al. ..... 210/163
2005/0051499 A1 * 3/2005 Nino ..... 210/747
2005/0069386 A1 * 3/2005 Happel et al. ..... 405/40
2005/0183997 A1 * 8/2005 Happel et al. ..... 210/163
2005/0218049 A1 * 10/2005 Happel ..... 210/163
2005/0247612 A1 * 11/2005 Glassheim ..... 210/163
2006/0049085 A1 * 3/2006 Parker ..... 210/163
2006/0124519 A1 * 6/2006 Glazik ..... 210/163
2006/0163130 A1 * 7/2006 Happel et al. ..... 210/163
2006/0201860 A1 * 9/2006 Happel et al. ..... 210/162
2006/0231508 A1 * 10/2006 Marzett et al. ..... 210/767
2006/0266681 A1 * 11/2006 Lockerman et al. ..... 210/163
2007/0187310 A1 * 8/2007 Weir et al. ..... 210/163
2008/0000845 A1 * 1/2008 Lockerman et al. ..... 210/767
2008/0006568 A1 * 1/2008 Moody et al. ..... 210/164
2008/0093280 A1 * 4/2008 Kang ..... 210/163
2009/0101553 A1 * 4/2009 Lucas ..... 210/164
2009/0134081 A1 * 5/2009 Happel et al. ..... 210/162
2009/0145829 A1 * 6/2009 Happel ..... 210/170.03
2009/0152181 A1 * 6/2009 Happel et al. ..... 210/162
2009/0166279 A1 * 7/2009 Happel et al. ..... 210/170.03
2010/0032363 A1 * 2/2010 Happel ..... 210/242.1
2010/0078370 A1 * 4/2010 Happel ..... 210/122
2010/0230338 A1 * 9/2010 Happel ..... 210/170.03

* cited by examiner

BACKWASHING FILTER BASKET

This application claims the benefit of U.S. Provisional Application No. 61/007,747, filed Dec. 17, 2007.

BACKGROUND OF THE INVENTION

The present invention is for a backwashing filter basket for an overflow structure for a retention pond or the like. The backwashing filter basket is attached to the overflow structure over the outlet weir so that floating debris, such as trash, leaves, grass clippings, tree stems and the like, is captured by the filter basket while sand, gravel and non-floating materials pass through the filter screen. The backwashing filter is backwashed by the falling rain.

An overflow structure is in retention ponds to prevent storm water from leaving the retention pond to allow the water to soak into the ground in the pond until the water level reaches a maximum height. The control or overflow structure has a cutout area in one side thereof forming a weir to allow the gradual overflow of the retention pond water through the structure and into the area storm water runoff. The retention pond however collects floating grass clippings, leaves, debris and other floating matter while sand, gravel and non-floating matter settles in the pond. Non-floating matter settles in the retention pond or in the control structure while the floating matter is allowed to flow into the control overflow structure and ultimately over the overflow weir where it is captured in the storm water system screens placed over the overflow weir.

These screens work well except they have a tendency to get stopped up with floating trash which reduces and blocks the flow of the overflow structure. It is desirable to remove floating organic debris from the water collected within a retention pond and overflow structure before it enters into a storm water runoff.

In my prior U.S. Pat. No. 7,270,747 a storm water drain system has a nutrient separating filter basket installed within the storm water drain pipe system to receive storm water runoff therethrough and to collect organic materials, such as grass clippings, leaves and tree stems, and to hold these organic materials above the water level in the storm water drain system to prevent their decay and release of soluble nutrients into the water. In this prior patent, water enters the housing inlet and is directed by an inlet feed chute into the basket and through the screen side and bottom while a filter bottom collects the organic debris therein.

The present invention is directed towards a filter or filter basket for an overflow structure for a retention pond or the like which is automatically cleaned by falling rain or water.

SUMMARY OF THE INVENTION

A self-cleaning filter basket for a storm water system and the like has a filter basket frame having an open side for receiving the inflow of water from an overflow structure. The filter basket frame has sides that angle inwardly towards a center axis and are covered with a filter screen to form an angled filter screen surface. The filter basket has a top covering the filter basket frame which top also has angled surfaces extending over the angled filter screen. Each filter basket top angled surface has an opening therethrough for directing water from the top onto the angled screen filter so that water, such as rain water or the like, entering the opening in the filter basket cover impinges upon the angled screen surface to flush the accumulated debris therefrom. A self-cleaning filter basket may have a plurality of angled screen sides with a top having a plurality of angled surfaces each having an opening therethrough for directing water onto one of the angled side filter screens. The filter basket frame has flanges attached thereto adjacent the open side for attaching the filter basket to the overflow structure. The filter basket may also have a plurality of generally vertical sides, each having a filter screen attached thereto to form a plurality of screen sides above the plurality of angled screen surfaces which may be added as an insert to extend the length of the filter basket.

BRIEF DESCRIPTION OF THE DRAWINGS

Other objects, features, and advantages of the present invention will be apparent from the written description and the drawings in which.

DESCRIPTION OF THE PREFERRED EMBODIMENTS

Figure 1:
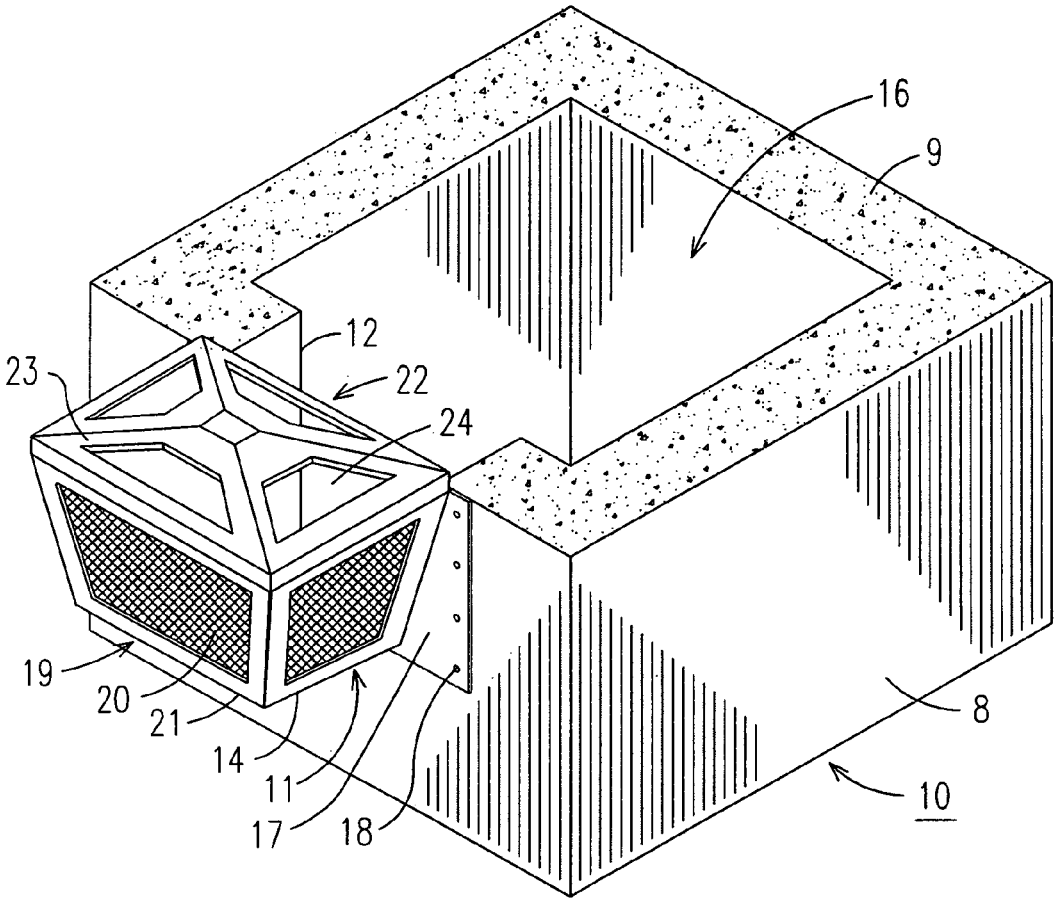
FIG. 1 is a perspective view of a backwashing filter basket in accordance with the present invention attached to an overflow control structure.
Figure 2:
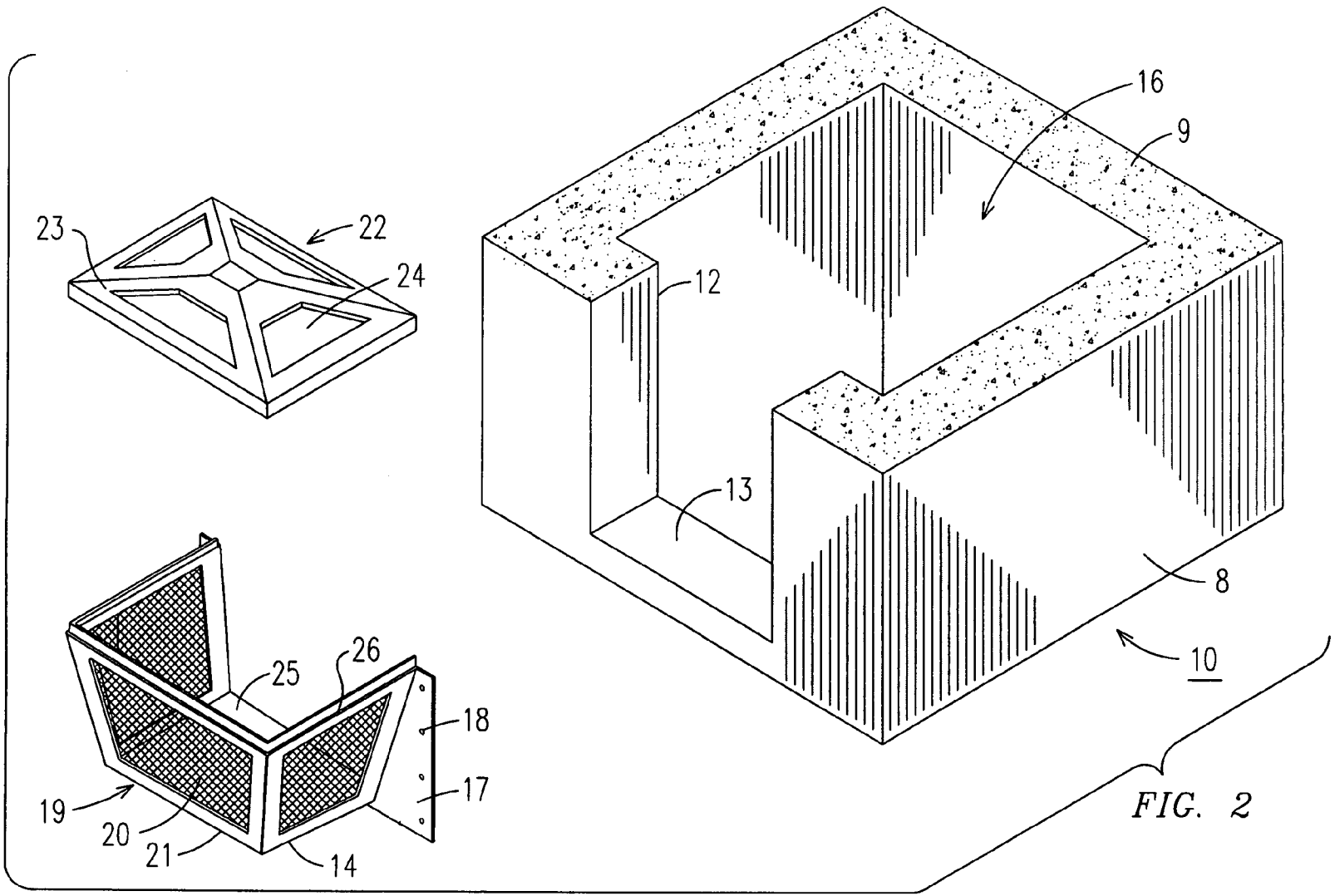
FIG. 2 is an exploded view of the backwashing filter basket and overflow control structure of FIG. 1.

Referring to FIGS. 1 and 2 of the drawings, an overflow control structure 10 is shown in FIG. 1 having a backwashing filter basket 11 attached thereto covering a water control area 12 and over the weir 13 formed by the cutout 12. The overflow control structure is generally made of concrete and has a plurality of sides 8 and a top 9 and forms a chamber 16 for the collection of overflow water from a retention pond or the like. The water in the overflow control structure 10 continues to fill until it reaches the height of the weir 13 where the water overflows the weir and flows into a storm water runoff. Floating debris that enters the chamber 16 will flow with the overflow water over the weir 13 and into the storm water runoff. Filter screens placed over the water control cutout 12 will collect the floating organic debris and retain it, blocking the flow of water as the leaves and debris accumulate on the filter screen.

The backwashing filter basket 11 has a frame 14 which may be made of steel or of a polymer, as desired, and includes attaching flanges 15. The flanges 15 have holes therein where anchoring fasteners 16 attach the backwashing filter basket 11 to the wall of the overflow water control structure 10 covering the cutout area 12 and the weir 13. The filter basket 11 also has angled sides having a filter screen 20. The sidewalls 19 having the side frame members 14 and filter screens 20 placed at an outwardly extending angle forming a generally reversed truncated pyramid on three sides angling towards the bottom 21 of the filter basket 11.

Filter basket 11 has a top 22 having a plurality of sides 23, each angled in the opposite direction from the angle of the sides 19. The top 22 forms a generally truncated pyramid on top of the backwashing filter basket 11 and has a plurality of backwashing openings 24. Openings 24 are positioned at an angle with the angles of the sides 23 angling into the openings 24 so that rainwater falling onto the top 22 of the filter basket is directed against the angled side screens 20 to a backwash and clear accumulated leaves and debris from the screens 20 of the sidewalls 19. The filter basket 11 also has a bottom 25 and forms a lip 26 around the top for accepting the cover 22 thereonto.

In operation, the overflow control structure 10 chamber 16 fills with water until it exceeds the level of the weir 13 of the cutout 12 where it overflows through the filter basket 11 and out the filter mesh 20 of the sides 19. As floating debris accumulates on the inside of the mesh 20, it clogs the filter basket 11 until rain or pouring water enters the openings 24 of the top 22 sides 23 which are angled to allow the water to impinge upon the side of the screens 20. The screens 20 are angled down so that the rain water hits against the debris and organic matter on the inside of the screen to automatically clear the filter screens 20 during rainy weather or whenever falling water passes through the openings 24. The sides 23 of the top 22 are angled to direct water directly against the sides of the screens 20 at an angle.

Figure 3:
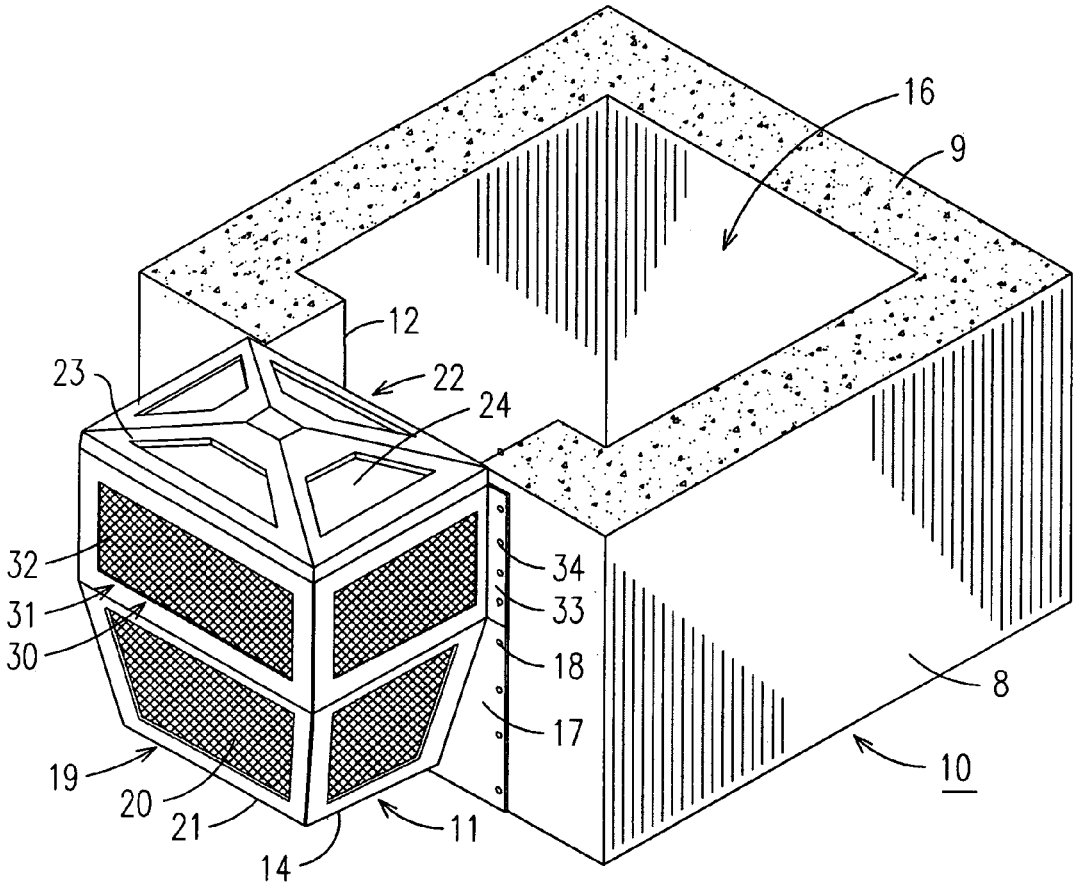
FIG. 3 is a second embodiment of a backwashing filter basket for an overflow control structure.
Figure 4:
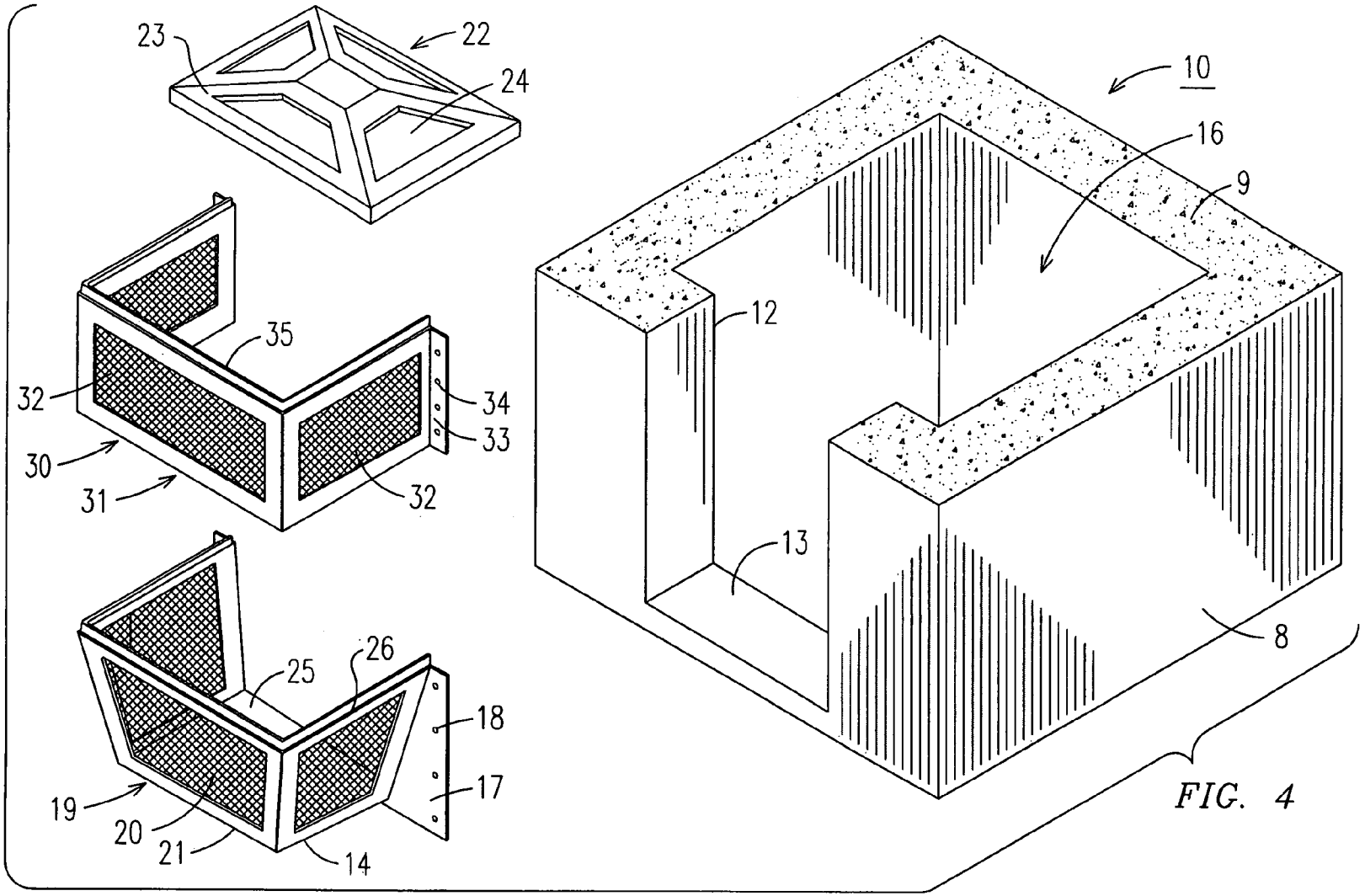
FIG. 4 is an exploded view of the backwashing filter basket of FIG. 3.

Turning to FIGS. 3 and 4, an alternate embodiment of the backwashing filter screen of FIGS. 1 and 2 is illustrated. The skimmer basket of FIGS. 1 and 2 works on most overflow control structures but there are cases where a taller screened filter basket is desired.

In FIGS. 3 and 4, the overflow water control structure 10 have sides 8 and a top 9 and form an overflow water chamber 16 and has the overflow cutoff 12 forming a weir 13. In this embodiment, the top 22 is the same as in FIGS. 1 and 2, and has angled openings 24 in the angled sides 23. The angled skimmer basket 11 is also identical to that of FIGS. 1 and 2 and has mounting flanges 15 having openings 18 for fastening to the overflow control structure 10. The skimmer basket 11 has angled sides 19 and frame members 14 having a filter screen 20 positioned therein placed at an angle to receive rainfall from the angled openings 24 in the top 22. The embodiments shown in FIGS. 3 and 4 is for those situations requiring screened skimmers. A height extending section 30 has been added having a framework 31 supporting filter screens 32 and having a flange 33 attached to the framework 31. A plurality of openings 34 in flange 33 attaches the section 30 to the overflow control structure 10 between the skimmer basket 11 and a top 22. The sides of the basket extension 30 are generally vertical so as to not to interfere with the overflow of water coming in from the top 22 openings 24 to flush the inside surface of the filter screens 20 of the skimmer basket 11.

The skimmer basket extension 30 has an edge 35 which accommodates the top 22 for setting thereon for removably attaching the top 22 to the skimmer basket extension 30 over the lip 35. The bottom of the skimmer basket 30 also has a lip designed to connect over the skimmer basket lip 26. The skimmer basket extension 30 may be added at any time to the skimmer basket for an overflow water control structure to accommodate a larger size opening 12 in an overflow control structure 10.

It should be clear at this time that a skimmer basket having a filter screen for an overflow control structure which collects, concentrates and directs rainwater against the angled walls of a skimmer filter screen for backwashing and cleaning the filter screen. However, the present invention is not to be construed as limited to the forms shown which are to be considered illustrative rather than restrictive.

We claim:

1. In a storm water retention pond system having an overflow weir, the improvement comprising a self cleaning filter basket including:

a filter basket frame having an open side for receiving an inflow of water having debris therein from said overflow weir, said filter basket frame having a plurality of sides angling inwardly toward the center axis, each of said plurality of sides having a filter screen attached thereto to form a plurality of angled filter screen surfaces; and a filter basket top covering said filter basket frame, said top having a plurality of angled surfaces extending over said angled filter screens and said filter basket top angled surfaces having openings therethrough which are constructed and arranged for directing water onto said angled filter screens;

wherein water entering the openings in said filter basket top impinges upon said angled screen surfaces to flush any accumulated debris therefrom.

2. The system of claim 1 wherein said filter basket frame has a three sides angling inwardly toward the center axis, each of said three sides having a filter screen attached thereto to form three angled filter screen surface.

3. The system of claim 2 wherein said filter basket top has three angled surfaces, each angled surface having an opening therethrough for directing water onto one of said angled side filter screens.

4. The system of claim 1 wherein said filter basket frame has a pair flanges attached thereto adjacent said open side for attaching said filter basket to an overflow structure of said retention pond system.

5. The system of claim 1 wherein said filter basket frame has a plurality of generally vertical sides each having a filter screen attached thereto to form a plurality of screened sides above said plurality of angled screened surfaces.

* * * * *